US010583065B1

(12) United States Patent
Mejia

(10) Patent No.: US 10,583,065 B1
(45) Date of Patent: Mar. 10, 2020

(54) POSTURE-CORRECTING WALKER

(71) Applicant: Melanie Mejia, Hollis Hills, NY (US)

(72) Inventor: Melanie Mejia, Hollis Hills, NY (US)

( * ) Notice: Subject to any disclaimer, the term of this patent is extended or adjusted under 35 U.S.C. 154(b) by 0 days.

(21) Appl. No.: 16/249,570

(22) Filed: Jan. 16, 2019

(51) Int. Cl.
*A61H 3/04* (2006.01)
*A61H 3/00* (2006.01)

(52) U.S. Cl.
CPC ..... *A61H 3/04* (2013.01); *A61H 2003/006* (2013.01); *A61H 2201/1635* (2013.01); *A61H 2203/0406* (2013.01)

(58) Field of Classification Search
CPC ..... A61H 3/04; A61H 2003/006
USPC ..... 135/67, 71, 912
See application file for complete search history.

(56) References Cited

U.S. PATENT DOCUMENTS 2,634,790 A * 4/1953 Elle ..... A61H 3/00 135/67
2,811,978 A 11/1957 Russell
RE24,817 E * 4/1960 Hogan ..... A61H 3/04 297/6
3,550,602 A 12/1970 Hesterman
3,625,237 A 12/1971 Wertz
4,248,256 A 2/1981 Thomas
4,251,105 A * 2/1981 Barker ..... A61H 3/04 135/67
7,422,025 B1 9/2008 Waldstreicher et al.
7,494,138 B2 2/2009 Graham
7,992,584 B1 * 8/2011 Birnbaum ..... A61H 3/04 135/67
8,002,295 B1 * 8/2011 Clark ..... A61H 3/04 16/110.1
8,540,256 B1 * 9/2013 Simpson ..... A61H 3/00 135/67
9,022,397 B1 5/2015 Prettyman
2008/0029138 A1 2/2008 Foote
2010/0263697 A1 10/2010 Catton
2013/0319488 A1 * 12/2013 Chiu ..... A61H 3/00 135/67
2017/0112706 A1 * 4/2017 Bruk ..... A61H 3/04

* cited by examiner

*Primary Examiner* — David R Dunn
*Assistant Examiner* — Danielle Jackson
(74) *Attorney, Agent, or Firm* — Goldstein Law Offices, P.C.

(57) ABSTRACT

A posture-correcting walker for assisting a user in performing safe ambulation, comprising a frame having a pair of front legs and a pair of rear legs joined together by a pair of horizontal supports, a pair of handgrips positioned on the horizontal supports, and a pair of forearm guiding supports which project upwardly at a rearward angle which are adapted to maintain the user's elbows and forearms at a guided posture angle during ambulation to ensure correct walking posture with the user's legs maintained within the frame. The forearm guiding supports each have a retaining cradle which supports the forearms and restricts rearward and sideways motion. The walker further has a descending segment ahead of each handgrip to ensure correct placement of the hands, as well as a pair of stabilizing segments which cause the rear legs to project rearwardly which stabilize the walker.

11 Claims, 4 Drawing Sheets

POSTURE-CORRECTING WALKER

TECHNICAL FIELD

The present disclosure relates generally to a walker device for assisting ambulation by a user. More particularly, the present disclosure relates to a posture-correcting walker device adapted to correct the walking posture of the user.

BACKGROUND

Walkers serve as stable walking aids which assist in the ambulation of people with impaired walking ability due to physical infirmity, disabilities, or injuries. Walkers generally take the form of a four-legged metal frame positioned in front of the user, with handles which the user grasps while walking, thereby providing both stability and weight bearing assistance.

Many walker users employ their walkers incorrectly, by advancing the walker too far ahead of their body while walking. Instead of the proper transfer of weight through the forearms to the walker, undue stress is placed on the user's hands, leading to cramping. Furthermore, advancing the walker too far ahead causes the user's back to stoop, resulting in deteriorating posture, and back, shoulder, and neck pain.

Walker devices which provide support to the user's forearms exist in the prior art. One such example combines a crutch-like extension with the walker frame, and braces the user's forearms and hands in fixed positions using straps. However, the straps of the prior art walker device prevent the user from independently using the walker, as the user would be physically incapable of applying or releasing the straps. Were the straps to be excluded from such device, correct placement of the user's hands would no longer be assured, resulting in potential improper walking posture.

There exists a need for an improved walker which corrects the user's walking posture by ensuring the user's hands, elbows, and forearms are correctly positioned for safe ambulation without unduly restricting the user's arms so that the walker is suitable for independent everyday usage.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a walker adapted to support a user's weight and assist the user in performing safe ambulation and correct the user's walking posture to safely transfer the user's weight to the walker through the user's hands and forearms. Accordingly, the present disclosure provides a posture-correcting walker having first and second front legs, first and second rear legs, a first horizontal support, a second horizontal support, a pair of handgrips positioned on the first and second horizontal supports, and a pair of forearm guiding supports which extend upwardly from the first and second horizontal supports. The forearm guiding supports receive and support the user's forearms while the user grasps the handgrips, ensuring that the angle of the user's elbows in flexion are maintained at a guided posture angle for proper transfer of weight to the walker through the forearms and hands.

It is another aspect of an example embodiment in the present disclosure to provide a walker which ensures the user properly advances the walker according to the correct walking posture while stepping forward. Accordingly, the present disclosure provides a posture correcting walker having a space within the frame between the first and second front legs and the first and second rear legs to accommodate the user's legs during ambulation. Furthermore, by maintaining the user's elbows in flexion at the guided posture angle, the user's legs remain within the space of the frame during ambulation, and the user's back is prevented from stooping.

It is yet another aspect of an example embodiment in the present disclosure to provide a walker which is usable by the user without the assistance of another person. Accordingly, the first and second horizontal supports each have a descending segment positioned directly in front of the handgrip to ensure consistent placement of the user's hands without restraints, and each forearm guiding support has a retaining cradle which restricts rearward and sideways motion of the forearm but which allows the forearm to be raised forwardly away from the retaining cradle upon cessation of the ambulation.

It is still yet another aspect of an example embodiment in the present disclosure to provide a walker which is stabilized against a rearward force applied to the walker through the forearm guiding supports. Accordingly, the present disclosure provides a walker further having a first and second stabilizing segment which extends rearwardly from the first and second rear legs to counteract the rearward force and improve stability.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
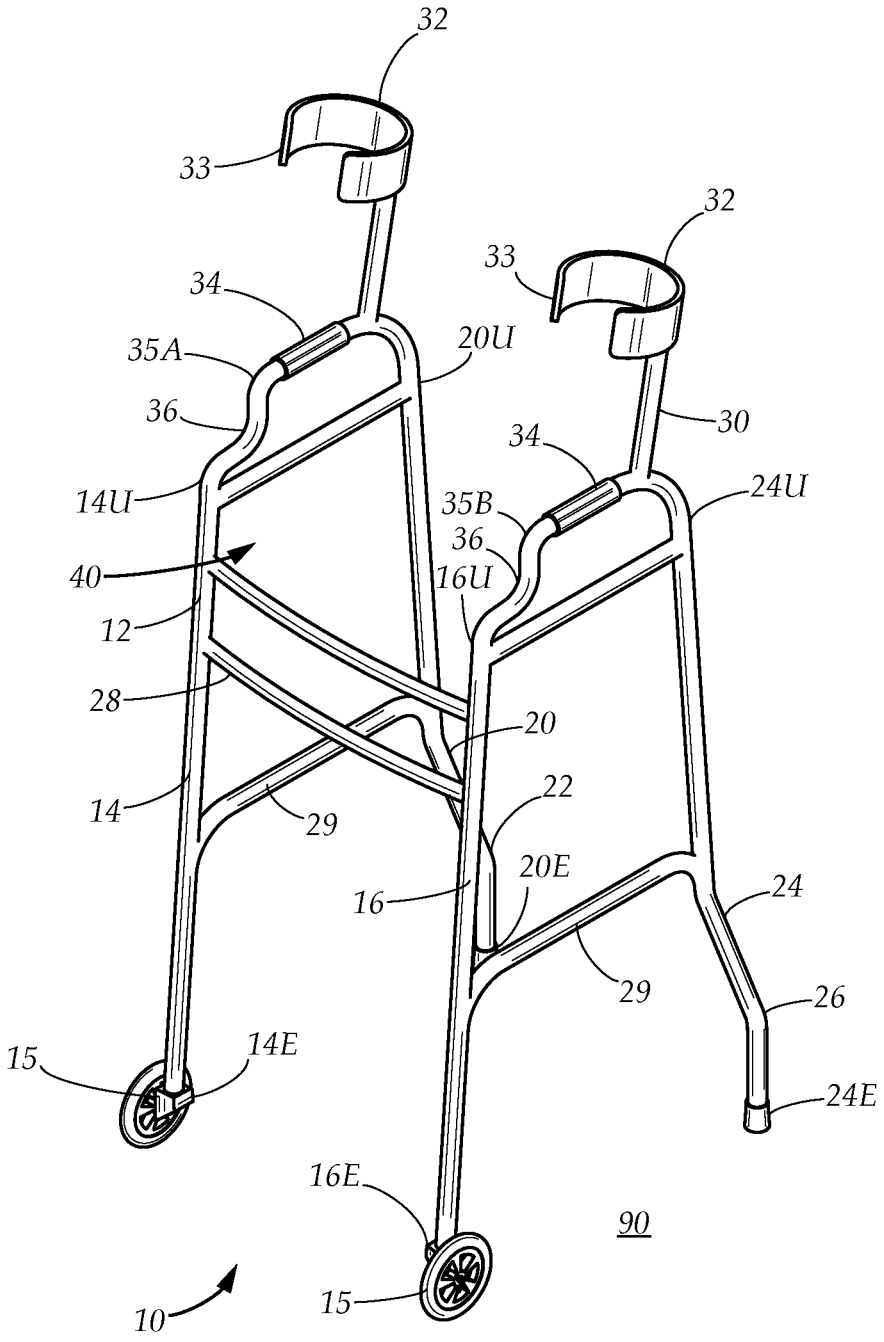
FIG. 1 is a diagrammatical perspective view of a posture-correcting walker comprising a frame with a pair of front legs and a pair of rear legs connected via horizontal supports, and a pair of forearm guiding supports extending upwardly from the frame, in accordance with an embodiment in the present disclosure.
Figure 3:
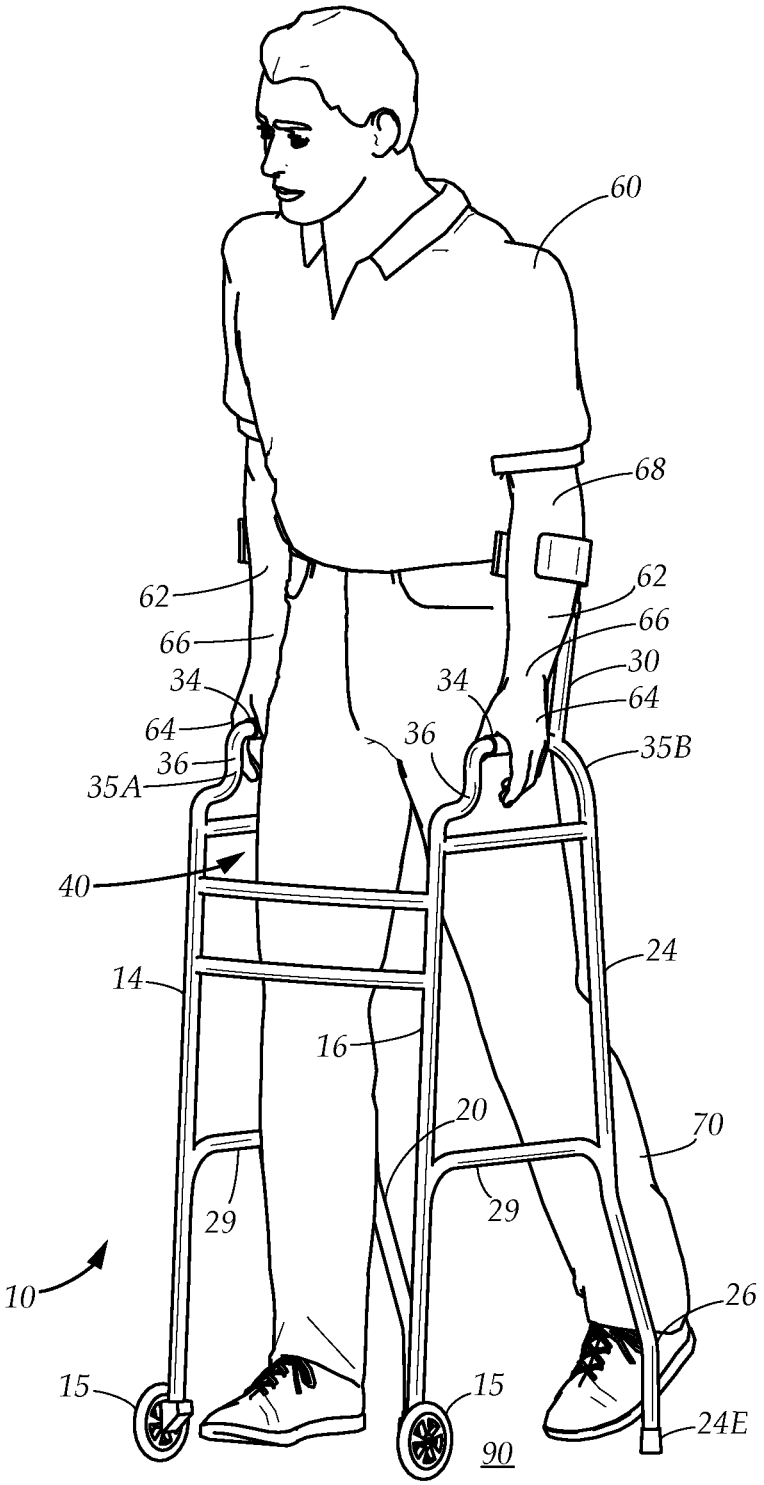
FIG. 3 is a diagrammatic perspective view of a user walking with the assistance of the posture-correcting walker, whereby the user grasps a pair of grips positioned on the horizontal supports while the user's legs are positioned within the frame, in accordance with an embodiment in the present disclosure.

FIG. 1 illustrates a posture-correcting walker 10 comprising a frame 12 and a pair of forearm guiding supports 30 which project upwardly therefrom. Turning briefly to FIG. 3, the posture-correcting walker 10 is adapted to ensure correct and safe ambulation by a user 60 upon a horizontal surface 90 such as a floor or ground. During ambulation, the user 60 manually advances the posture-correcting walker 10, by lifting and placing the posture-correcting walker 10 upon the horizontal surface 90 ahead of the user 60 while simultaneously stepping forward. In certain embodiments, the posture-correcting walker 10 further comprises a pair of wheels 15, allowing the user 60 to advance the walker 10 by rolling it forwardly instead. The posture-correcting walker 10 provides stability and bears the user's weight, while the forearm guiding supports 30 maintain the user's forearms 62 and elbows 68 at a proper angle in flexion, ensuring that the user 60 does not advance the posture correcting walker 10 too far ahead while walking.

Returning to FIG. 1 while also referring to FIG. 3, the frame 12 has a pair of front legs comprising a first and a second front leg 14, 16, a pair of rear legs comprising a first and second rear leg 20, 24, a first horizontal support 35A which joins the first front leg 14 and the first rear leg 20, and a second horizontal support 35B which joins the second front leg 16 and the second rear leg 24. The first front leg 14 has a first front leg upper end 14U and a distally positioned first front leg lower end 14E, and the first rear leg 20 has a first rear leg upper end 20U and a distally positioned first rear leg lower end 20E. The first horizontal support 35A joins the first front leg upper end 14U with the first rear leg upper end 20U. Similarly, the second front leg 16 has a second front leg upper end 16U and a distally positioned second front leg lower end 16E, and the second rear leg 24 has a second rear leg upper end 24U and a distally positioned first rear leg lower end 24E. The second horizontal support 35B joins the second front leg upper end 16U with the second rear leg upper end 24U. The posture-correcting walker 10 may further comprise a pair of wheels 15 which attached to the first and second front leg lower ends 14E, 16E, allowing the walker 10 to be advanced by the user 60 along the horizontal surface 90 through wheeled movement. In a preferred embodiment, the first and second horizontal supports 35A, 35B are substantially parallel, and the frame 12 further has one or more lateral supporting members 28 which are oriented substantially perpendicularly to the first and second horizontal supports 35A, 35B, and join the first and second front legs 14, 16 together. To further strengthen the frame 12, the posture-correcting walker 10 may further have a pair of side supporting members 29 which join the first front leg 14 to the first rear leg 20, and the second front leg 16 to the second rear leg 24.

Figure 2:
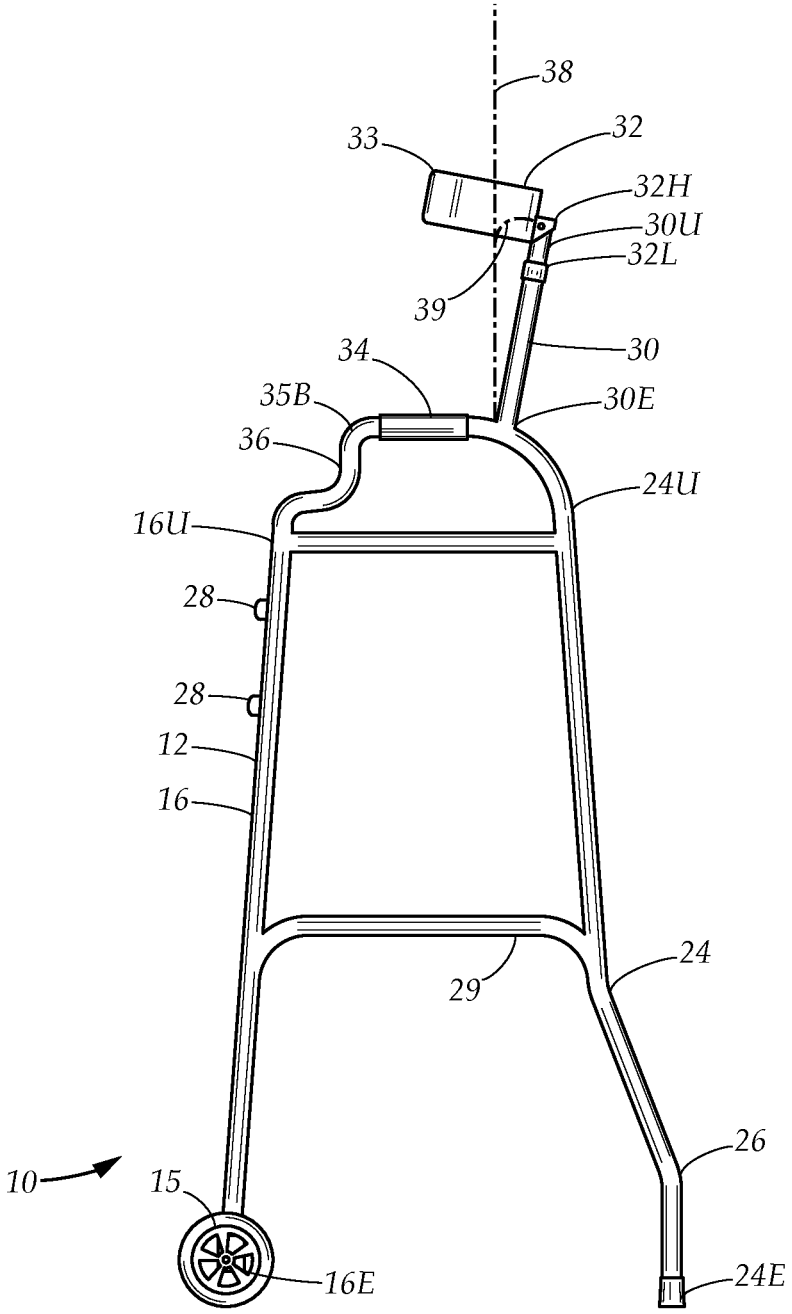
FIG. 2 is a diagrammatic side view of the posture-correcting walker, depicting the angled configuration of the forearm guiding support, and an angled stabilizing segment projecting rearwardly from the rear leg, in accordance with an embodiment in the present disclosure.

Referring to FIGS. 1-3, the frame 12 further has a space 40 formed between the first and second horizontal supports 35A, 35B and the lateral supporting member 28, which is adapted to allow the legs 70 of the user 60 to remain positioned therebetween while stepping forward with the assistance of the posture-correcting walker 10. Each forearm guiding support 30 has a guiding support lower end 30U which is attached to the first or second horizontal support 35A, 35B, and a distally positioned guiding support upper end 30E which projects upwardly therefrom. Each forearm guiding support 30 is disposed on the first or second horizontal support 35A, 35B in a position closer to first or second rear leg 20, 24 than to the first or second front leg 14, 16, so that each forearm guiding support 30 is located behind the user's forearm 62 when the posture-correcting walker 10 is in use. In certain embodiments, each forearm guiding support 30 is permanently affixed to the frame 12, and may be unitary with the first or second horizontal supports 35A, 35B.

Figure 4:
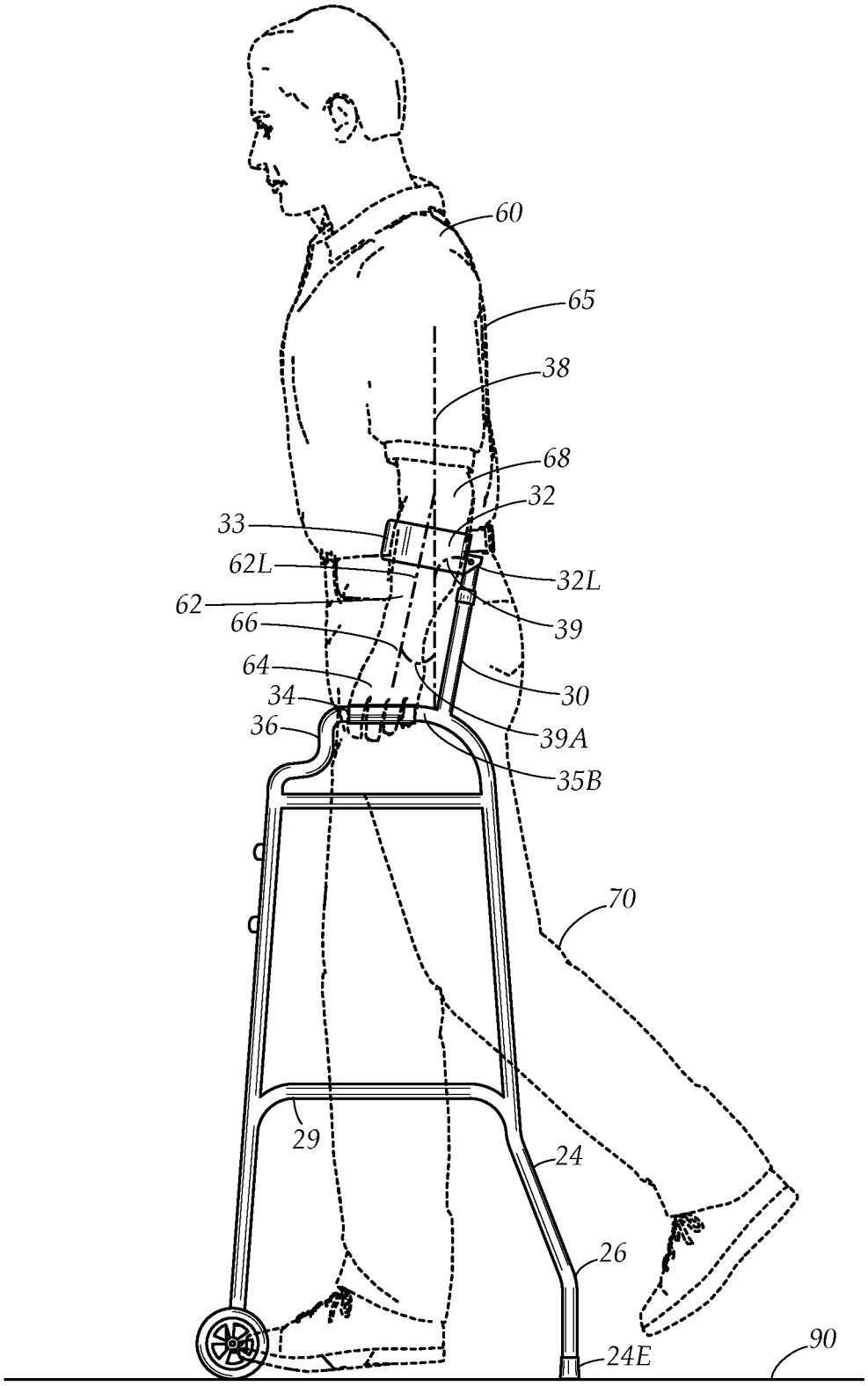
FIG. 4 is a diagrammatic side view of the user walking with the assistance of the posture-correcting walker, depicting the user's forearms and elbow being maintained at a proper angle relative to the horizontal support by the forearm guiding support, in accordance with an embodiment in the present disclosure.

Referring to FIG. 4 while also referring to FIGS. 2-3, the first and second horizontal supports 35A, 35B each have a handgrip 34 positioned between the forearm guiding support 30 and the first or second front leg 14, 16, allowing the user 60 to firmly grasp the posture-correcting walker 10. Each forearm guiding support 30 has a retaining cradle 32 adapted to receive and support the forearm 62 of the user 60 while the user 60 grasps the handgrips 34. Furthermore, each forearm guiding support 30 is angled rearwardly relative to a vertical line 38 projecting upwardly from the forearm support lower end 30E where it is attached to the first or second horizontal support 35A, 35B, corresponding to a guided posture angle 39 defined by an inclusive range of ten to twenty degrees. In a preferred embodiment, the forearm 62 of the user is substantially parallel with the forearm guiding support 30, and the position of the elbow 68 in flexion is defined by the forwardly oriented angle 39A created by the line of the forearm 62L intersecting with the vertical line 38. The precise angle of the forearm guiding support 30 in relation to the vertical line 38 is fixed, and may be any angle within the defined range of the guided posture angle, as long as the forearm guiding support 30 restricts the range of motion of the user's forearm 62 to ensure that the forwardly oriented angle 39A of the position of the elbow 68 and forearm 62 in flexion relative to the vertical line 38 cannot be greater than the guided posture angle 39 while the user 60 is grasping the handgrips 34.

Grasping the handgrips 34 to advance the posture-correcting walker 10 while the forearms 62 are in the guided posture angle 39 further ensures that the user's back 65 remains straight and the user's elbows 68 remain at an angle of between ten to twenty degrees in flexion. Furthermore, the user's legs 70 remain in the space 40 within the frame 12 of the posture-correcting walker 10 as the legs 70 step forward while walking. The forearm guiding supports 30 further ensure that the user's wrists 66 are kept substantially straight, allowing the user's weight to be distributed directly through the forearms 62 and hands 64 to the first or second horizontal supports 35A, 35B. The posture-correcting walker 10 therefore counters a tendency of users, when using a conventional walker without the forearm guiding supports 30, to advance the walker too far ahead of the user, with the forearms 62 extended, wrists 66 bent, and the back 65 in a stooped posture.

In a preferred embodiment, the first and second horizontal supports 35A, 35B each further have a descending segment 36 positioned in front of the handgrips 34 which initially extends downwardly and then extends forwardly to join with the first or the second front legs 14, 16 as appropriate. The descending segment 36 prevents the user 60 from circumventing the restriction of the forearm guiding supports 30 upon the range of motion of the forearms 62 by sliding the hands 64 forwardly off the handgrips 34 or by grasping the first or second horizontal support 35A, 35B in front of the handgrips 34, in order to increase the angle of the elbows 68 in flexion in relation to the vertical line 38. The descending segment 36 may therefore be positioned directly in front of the handgrip 34, where the presence of the descending segment 36 may physically block any forward movement by the user's hand 64. Each handgrip 34 may have a length approximately equal to the width of the user's hand 64, in order to ensure that the hand 64 is consistently placed to facilitate the proper angle of the elbow 68 in flexion.

Continuing to refer to FIG. 4 while also referring to FIGS. 1-3 simultaneously, the user 60 may, in certain situations, potentially exert a rearward force against the posture-correcting walker 10 by pushing or otherwise placing the user's weight against the forearm guiding supports 30. If sufficiently strong, the rearward force could destabilize the posture-correcting walker 10 and cause it to topple backwards. In order to counteract the rearward force, the first and second rear legs 20, 24 may further have a first stabilizing segment 22 and a second stabilizing segment 26 respectively. The first and second stabilizing segments 22, 26 are positioned below the side supporting members 29 and cause the first and second rear legs 20, 24 to initially extend rearwardly at an angle before extending downwardly to terminate in the first or second rear leg lower end 20E, 24E as appropriate. The first and second stabilizing segments 22, 26 therefore increase the distance between the first and second front leg lower ends 14E, 16E and the first and second rear leg lower ends 20E, 24E, and provide increased stability to counteract the rearward force, without increasing the angle of the first and second rear legs 20, 24 as a whole or significantly increasing the overall size and weight of the frame 12 itself.

Referring to FIG. 1 and FIGS. 2-3, each retaining cradle 32 has a forwardly opening curve 33 which allows the forearm 62 to be guided and retained thereon. The curve 33 restricts rearward and sideways movement of the forearm 62 without blocking its forward movement, allowing the forearms 62 to be raised forwardly away from the retaining cradle 32. Unlike certain conventional walkers which rely on binding restraints to maintain the proper positioning of the hands 64 and forearms 62, the walker 10 does not prevent the user 60 from freely detaching the user's forearms 62 and hands 64 from the handgrips 34 or retaining cradle 32 upon cessation of the ambulation, or repositioning the forearms 62 and hands 64 upon its resumption, without the assistance of another person. In a preferred embodiment, the retaining cradle 32 is attached to the guiding support upper end 30U. In certain embodiments, each forearm guiding support 30 further has an extension mechanism 32L which allows the length of the forearm guiding support 30 to be selectively increased or decreased, further allowing the retaining cradle 32 to be adjusted to an optimal position of approximately one or two inches below the user's elbow 68. In certain embodiments, the curve 33 has a layer of padding adapted to cushion the forearm of the user.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a posture-correcting walker. The disclosure is illustrated by example in the drawing figures, and throughout the written description. It should be understood that numerous variations are possible, while adhering to the inventive concept. Such variations are contemplated as being a part of the present disclosure.

What is claimed is:

1. A walker adapted to assist a user in performing safe ambulation upon a horizontal surface, the user having a hand, forearm, elbow, legs, a back, and a walking posture, the walker is adapted to be forwardly advanced by the user while stepping forward, the walker comprising:

a frame adapted to support the user's weight during ambulation, the frame having a first front leg, a second front leg, a first rear leg, a second rear leg, a space defined between the first and second front legs and the first and second rear legs which is adapted to accommodate the legs of the user therebetween, a first horizontal support which connects the first front leg with the first rear leg, and a second horizontal support which connects the second front leg with the second rear leg;

a pair of handgrips positioned on the first and second horizontal supports which are adapted to be grasped by the hand of the user;

a pair of forearm guiding supports having a guiding support lower end and a distally oriented guiding support upper end, the first and second horizontal supports are each connected to the guiding support lower end of one of the pair of forearm guiding supports such that each forearm guiding support extends upwardly at a rearward angle relative to a vertical line projecting upwardly from the guiding support lower end, the rearward angle corresponding to a guided posture angle, the guided posture angle is an inclusive range of between ten and twenty degrees relative to the vertical line; and a pair of retaining cradles, each attached to the guiding support upper of one of the forearm guiding supports, each retaining cradle having a forwardly opening curve which is adapted to receive and support the forearm of the user below the elbow, each forearm guiding support and the retaining cradle attached thereto are adapted to maintain the elbow of the user in flexion at the guided posture angle while the hand grasps the handgrip during ambulation, thereby allowing the walker to correct the walking posture of the user by preventing the user's back from stooping while forwardly advancing the walker; and wherein the first and second horizontal supports each have a descending segment positioned directly in front of the handgrip, the descending segment initially extends downwardly away from the handgrip before extending forwardly to join with the first or second front leg as appropriate, the descending segment is adapted to prevent the user from sliding the hand forwardly to alter the position of the elbow in flexion.

2. The walker as described in claim 1, wherein by being adapted to maintain the elbow of the user in flexion at the guided posture angle, the walker is adapted to further correct the walking posture of the user by ensuring the legs of the user remain within the space of the frame during ambulation.

3. The walker as described in claim 1, wherein:

the first front leg further has a first front leg lower end, the second front leg further has a second front leg lower end, the first rear leg further has a first rear leg lower end and first stabilizing segment, and the second rear leg further has a second rear leg lower end and a second stabilizing segment, the first and second stabilizing segments extend rearwardly before extending downwardly to terminate in the first and second rear leg lower ends respectively, the first and second stabilizing segments are adapted to stabilize the walker upon the horizontal surface and prevent the walker from tipping over as a result of a rearward force, by increasing the distance between the first front leg lower end and the first rear leg lower end, and the distance between the second front leg lower end and second rear leg lower end.

4. The walker as described in claim 3, wherein the curve of each retaining cradle is adapted to restrict sideways and rearward movement of the forearm, without restricting the forward movement of the forearm away from the retaining cradle.

5. The walker as described in claim 4, wherein each forearm guiding support further has a guiding support extension mechanism adapted to selectively increase or decrease the distance between the guiding support lower end and the guiding support upper end, and alternatively raise or lower the retaining cradle attached thereto.

6. The walker as described in claim 5, wherein the walker further comprises a pair of wheels attached to the first and second front leg lower ends, the wheels are adapted to allow the user to forwardly advance the walker over the horizontal surface using wheeled movement.

7. A method for assisting a user in performing safe ambulation upon a horizontal surface, the user having a hand, forearm, elbow, legs, a back, and a walking posture, the method comprising the steps of:

providing a walker having:

a frame having a first front leg, a second front leg, a first rear leg, a second rear leg, a space defined between the first and second front legs and the first and second rear legs, a first horizontal support which connects the first front leg with the first rear leg, and a second horizontal support which connects the second front leg with the second rear leg;

a pair of handgrips positioned on the first and second horizontal supports which are adapted to be grasped by the hand of the user, the first and second horizontal supports each have a descending segment positioned directly in front of the handgrip, the descending segment initially extends downwardly away from the handgrip before extending forwardly to join with one of the first and the second front leg;

a pair of forearm guiding supports which are connected to the first and second horizontal supports and extend upwardly at a rearward angle relative to a vertical line, the rearward angle corresponding to a guided posture angle; and a pair of retaining cradles each attached to one of the forearm guiding supports, each retaining cradle having a forwardly opening curve;

standing within the space of the frame by the user, and positioning the user's legs between the first front leg and first rear leg and the second front leg and the second rear leg;

grasping the handgrips by the hands of the user and supporting the forearms by placing the forearms upon the retaining cradles;

maintaining the elbows of the user in flexion at an angle corresponding to the guided posture angle of ten to twenty degrees by maintaining the elbows of the user in flexion at an angle which does not exceed the range of the guided posture angle;

preventing the user from sliding the user's hand forwardly off the handgrip to alter the position of the elbow in flexion, by blocking the sliding of the user's hand using the descending segment;

advancing the walker forwardly ahead of the user while maintaining the elbows in flexion at the guided posture angle causing the legs of the user to remain within the space of the frame during ambulation, stepping forward, and supporting the user's weight using the walker; and correcting the walking posture of the user by preventing the user's back from stooping as the user advances the walker.

8. The method of claim 7, wherein:

the walker further has a first stabilizing segment and a second stabilizing segment which cause the first and second legs to project rearwardly and then downwardly against the horizontal surface; and the step of correcting the walking posture of the user is followed by the step of:

countering a rearward force exerted upon the walker by the forearms of the user against the forearm guiding supports, using the first and second stabilizing segments.

9. The method of claim 8, wherein:

the walker further has a pair of wheels connected to the first and second front legs, and the step of advancing the walker forwardly ahead of the user further comprises the step of rolling the walker forward across the horizontal surface using the wheels.

10. The method of claim 9, wherein:

the curve of each retaining cradle is adapted to restrict rearward and sideways motion of the forearm supported therein;

the step of maintaining the elbows of the user in flexion further comprises the step of supporting the forearm within the curve by restricting the rearward and sideways motion of the forearm; and the steps as recited are followed by the step of:

releasing the handgrips by the user, and lifting the user's forearms forwardly away from the retaining cradles upon cessation of the ambulation.

11. The method of claim 10, wherein:

each forearm guiding support further has a guiding support extension mechanism adapted to alternatively raise or lower the retaining cradle attached thereto; and the step of standing within the space of the frame is followed by the step of:

alternatively raising or lowering the retaining cradles using the guiding support mechanisms such that the retaining cradles are positioned below the user's elbows.

* * * * *